United States Patent [19]

Crumby

[11] 4,160,294

[45] Jul. 10, 1979

[54] TWO-STAGE FLUSH MECHANISM FOR TOILETS

[76] Inventor: John T. Crumby, Tri-County Blvd., Oliver Springs, Tenn. 38740

[21] Appl. No.: 842,336

[22] Filed: Oct. 14, 1977

[51] Int. Cl.[2] ..... E03D 1/14; E03D 1/33

[52] U.S. Cl. ..... 4/324; 4/393; 4/394; 4/397; 4/DIG. 1

[58] Field of Search ..... 4/324–327, 4/345, 346, 378–381, 384, 391–393, 397, 399, 415, DIG. 1, 356–358, 382, 394–396, 398, 400, 401; 251/82, 228, 229, 298

[56] References Cited

U.S. PATENT DOCUMENTS

| | | | |
|---|---|---|---|
| 370,433 | 9/1887 | Wellington | 4/346 |
| 403,926 | 5/1889 | Doherty | 4/345 |
| 419,566 | 1/1890 | Scott | 4/393 |
| 1,426,203 | 8/1922 | Leeberg | 4/393 X |
| 2,270,989 | 1/1942 | Asselin | 4/382 |
| 3,538,519 | 11/1970 | Weisz | 4/325 |
| 3,561,014 | 2/1971 | Johnson | 4/381 |
| 3,823,425 | 7/1974 | Coffman | 4/325 |
| 3,964,109 | 6/1976 | Street et al. | 4/327 |

*Primary Examiner*—Stuart S. Levy

*Attorney, Agent, or Firm*—Scrivener, Parker, Scrivener and Clarke

[57] ABSTRACT

A two-stage toilet flush mechanism is provided in which operation of the usual control lever to a yieldable manually-felt detent point produces a partial flush the duration of which is controlled by the position of first float with respect to the initial water level in the storage tank, and movement of the lever beyond the detent point produces a complete flush the duration of which is controlled by the position of a second float with respect to the initial water level.

5 Claims, 5 Drawing Figures

FIG. 1
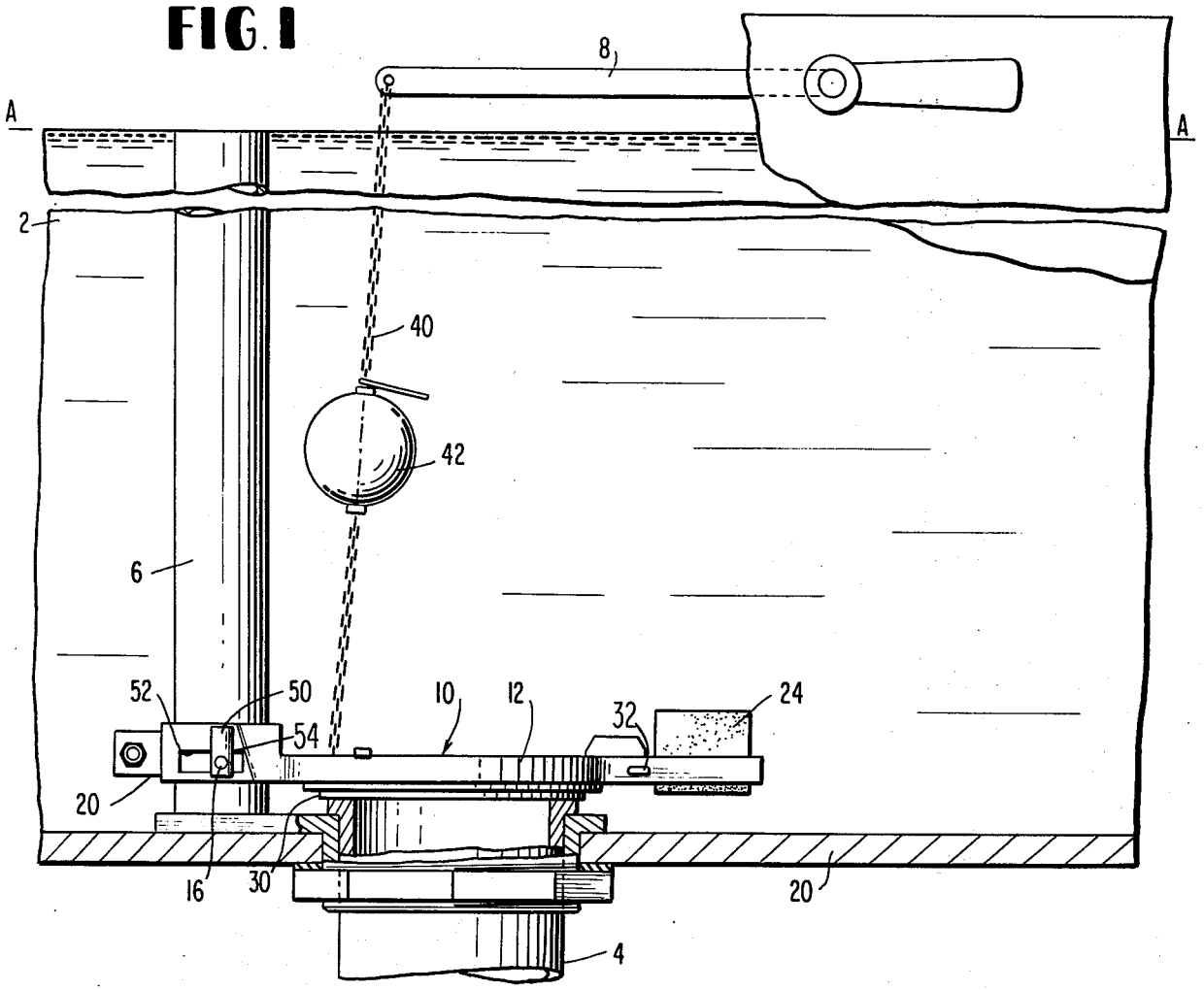
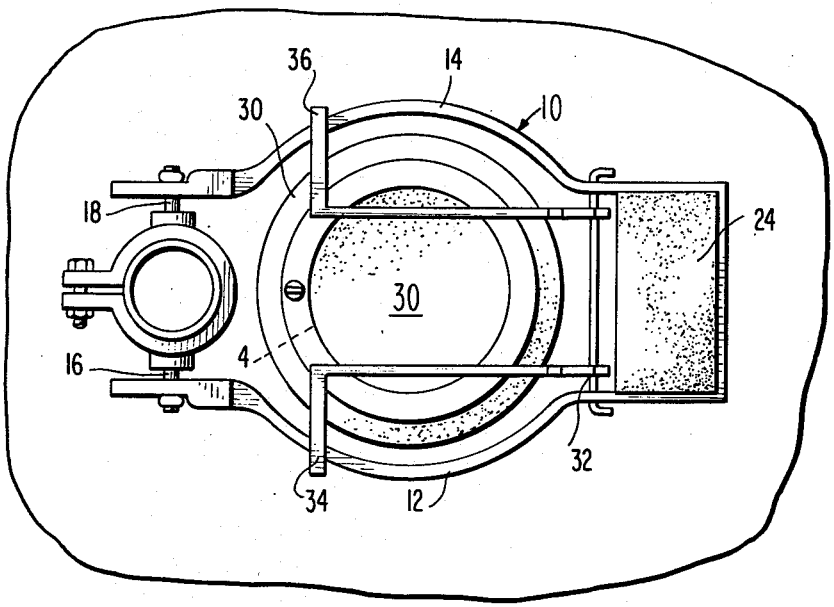
FIG. 2

TWO-STAGE FLUSH MECHANISM FOR TOILETS

BACKGROUND OF THE INVENTION

The invention relates generally to mechanisms for flushing toilet bowls and, more particularly, to such mechanisms for selectively causing either a lesser quantity of flushing water to be delivered to the bowl from the reservoir tank or, when desired, a maximum quantity of water to be delivered. Such two-stage systems conventionally utilize either a vertically movable ball valve or a pivoted flap valve, in either case with associated mechanism, to control the passage of water from the reservoir tank to the toilet bowl, and the present invention is primarily concerned with mechanism for providing a two-stage operation by a mechanism including a pivoted flap valve.

In the United States patent to Street, No. 3,964,109, there is disclosed a mechanism providing two-stage operation utilizing two pivoted flap valves, while in the U.S. Pat. to Coffman, No. 3,823,425, there is disclosed in FIGS. 12 to 15 a two-stage system utilizing a single flap valve but comprising a very complicated apparatus for controlling the two-stage operation of the valve. These patents are illustrative of the pertinent prior art with respect to the present invention, and it will be seen that the two-stage flap valve operating systems of the pertinent prior art are complicated, with consequent added initial cost and maintenance costs and problems.

It has therefore been the object of this invention to provide a simple and effective operating mechanism for selectively providing either a lesser or a greater flushing operation for a toilet bowl, utilizing only a single flap valve, with consequent saving in initial and maintenance costs and improved operation.

SHORT DESCRIPTION OF THE DRAWINGS

FIG. 1 is a cross sectional view of the reservoir tank of a flush toilet system, including the discharge control means provided by the invention, such means being shown in fully closed position;

FIG. 2 is a plan view of the control means;

SUMMARY OF THE INVENTION

Figure 5:
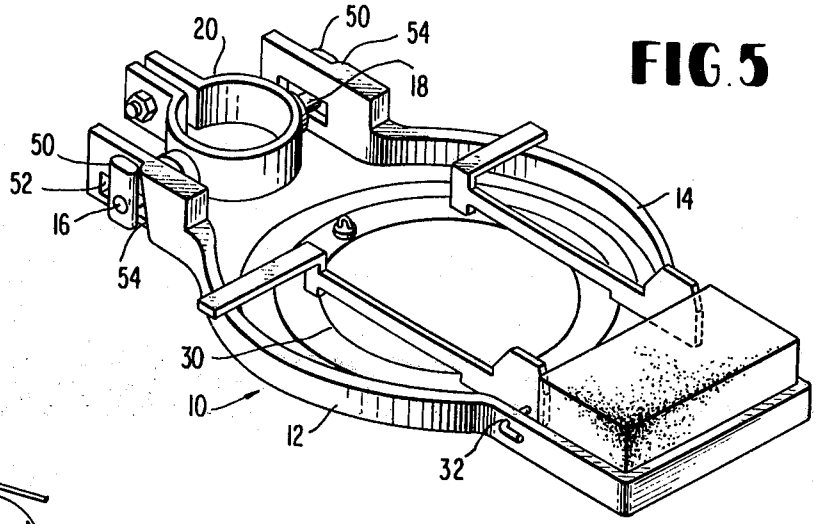
FIG. 5 is a perspective view of the valve means provided by the invention.

The means provided by the invention for controlling the discharge of water from the reservoir tank to the toilet bowl is a single flap valve which is movable to open position by manual operation of a lever which is connected to the valve through float means so positioned with respect to the normal water level in the tank that the valve is closed after discharge of part of the water in the tank when the lever is operated to a first position identified by a detent feel in the operation of the lever to effect a partial flush. The flap valve is pivotally connected to a frame which is itself pivotally connected to a fixed part of the tank and which is also provided with a float, whereby upon a predetermined movement of the lever beyond the detent feel position the flap valve is opened and the frame member is moved to an upper position where it holds the valve open and is supported by the float on the frame until there has been a complete flush, whereupon the frame-carried float causes the frame to return to normal position and the flap valve to return to closed position.

DESCRIPTION OF THE INVENTION

In the drawings forming part of this specification there is illustrated the reservoir tank 2 which forms part of a flush toilet system, the toilet bowl itself not being illustrated. A discharge pipe 4 connects the bottom of the tank to the toilet bowl and a standpipe 6 is provided which maintains the water in the tank at its normal level A—A. An operating lever 8 is pivotally mounted on the tank and is constructed and adapted for manual operation. These are conventional parts of a flush toilet.

Means are provided by the invention for controlling the discharge of water from the tank through the discharge pipe to the toilet bowl to selectively cause, at the will of the operator, either the discharge of only a part of the water in the tank or substantially all of the water in order to produce either a partial or a complete flush of the toilet bowl.

Such means comprise, first, a frame member 10 which is generally U-shaped in plan with outwardly bowed arms 12, 14, the free ends of which are pivotally mounted on aligned pins 16, 18 which extend from opposite sides of a bracket 20 which is fixed to the standpipe 6. The frame normally rests on the bottom wall 20 of the tank and the arms of the frame are of such length and configuration that their bowed parts are positioned on opposite sides of the opening to the discharge pipe 4 and closely adjacent thereto, as most clearly shown in FIG. 2. At its end opposite to its pivotal support on the pins 16, 18 the frame carries a float member 24 which may be of any desired type such as, for example, a porous mass of synthetic plastic material or a closed hollow member, the only requirement being that this member will float in water.

Within the bowed parts of the arms of the frame there is provided a generally flat flap valve 30 which is pivotally connected at its one edge at 32 to the frame at the end of the frame opposite to its pivotal support on pins 16, 18, the pivotal support of the flap valve therefore being adjacent the float 24. The flap valve is normally positioned covering the open upper end of the discharge pipe 4 as shown in FIG. 1. Two rigid arms 34, 36 extend laterally from the upper part of the flap valve to positions above the bowed parts of the arms 12, 14 and normally engage the upper edges of the arms when the parts are in their normal rest position as shown in FIG. 1, for a purpose which will be explained.

A flexible connecting member 40, which may be a beaded string, is connected at its lower end to the flap valve at a point remote from the pivotal support 32 of the valve, and has its upper end connected to the operating lever 8. A float 42 is carried by the connecting member and is preferably so connected thereto that its vertical position with respect to the normal level A—A of the water in the tank may be easily adjusted, as by frictional means.

Means are provided by the invention for producing a detent action when force is applied to raise the frame member about its pivotal support on pins 16, 18 from its normal position resting on the bottom wall of the tank. Each of the pins 16, 18 which extend in diametrically different directions from the bracket 20 is provided adjacent its outer end with a lug 50 which is rotatably mounted on the pin so that it can be turned from a normal position parallel to the bottom wall of the tank to a vertical position at right angles to the bottom wall. Each of the free ends of the arms 12, 14 is provided with an elongated opening 52 extending parallel to the length of the arm and of a vertical width which will receive one of the pins 16, 18 and of a horizontal length to receive a lug 50 when the lug is in a position parallel to the bottom wall of the tank. Adjacent the inner end of opening 52 each arm is formed with an offset surface 54 which extends at approximately right angles to the remainder of the surface of the arm. Each of these offset surfaces is inclined at an angle to the length of the arm, with its upper end adjacent but spaced from the upper end of the associated lug 50 when the lug is in its vertical position, and with its lower end displaced in the direction of the end of the frame to which the float 24 is attached. The arms 12, 14 are formed of spring material and are normally biased outwardly, away from each other, so that when assembled on the pins 16, 18 inwardly of the lugs 50 they constantly bear outwardly against the lugs.

OPERATION

In order to assemble the frame to its pivotal support on pins 16, 18 the lugs 50 are turned to their positions parallel to the bottom wall of the tank and the openings 52 in the arms are passed over the ends of the pins 16, 18 and the lugs 50 to positions inside the lugs, after which the lugs are turned to their vertical positions at right angles to the bottom wall of the tank, in which positions the upper end of each lug is positioned in spaced but close relation to the adjacent inclined offset surface 54.

Figure 4:
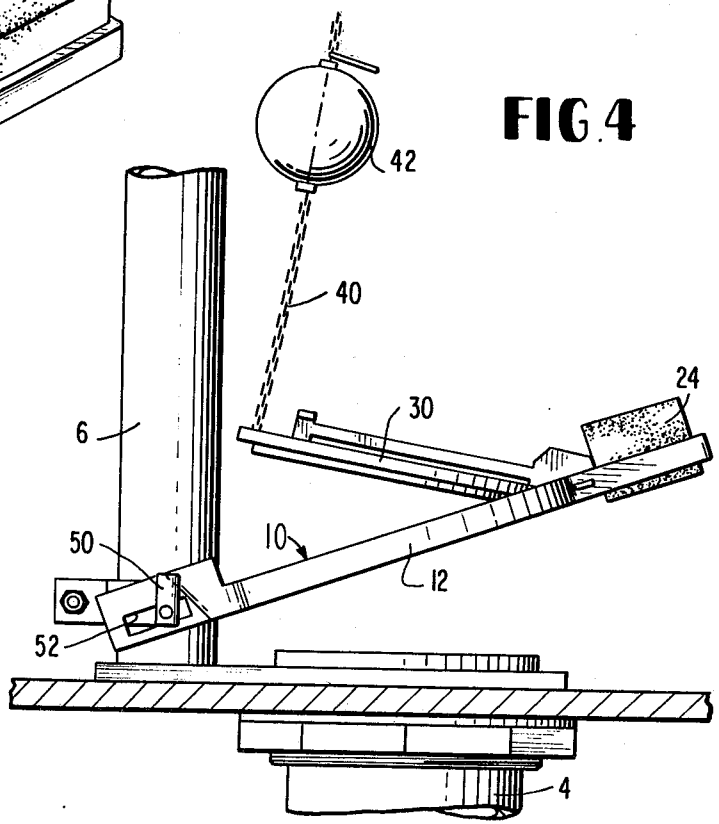
FIG. 4 is a view which is similar to FIG. 3 but shows the valve means in position to effect a full flush.
Figure 3:
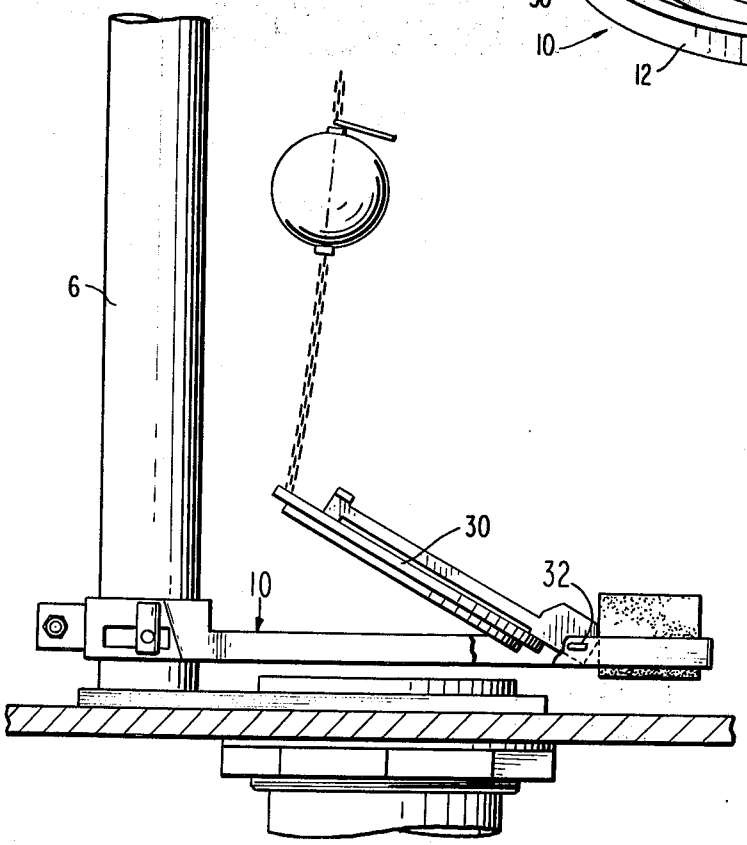
FIG. 3 is a view which is similar to FIG. 1 showing the valve means in position to effect a partial flush.

If it is desired to effect a partial flush of the toilet bowl, the lever 8 is operated to exert an upward pull on the connecting member 40 and the float 42 carried by it, and this movement of the lever is continued until the operator feels a detent caused by the engagement of the offset surfaces 54 against the upper end of the lugs 50. When the operator feels this detent, further movement of the lever can be stopped in order to effect a partial flush, or can be continued through the detent in order to effect a complete flush. If lever movement is stopped at the detent the flap valve 30 will be raised and the float 42 will be raised with it to a position within or below the normal water lever A—A, causing water to flow from the tank through the discharge pipe to the toilet bowl. When the water level drops to the level of the float 42 the float will move downwardly with it, and as it does so the flap valve will move downwardly with it until it closes the discharge pipe, thereby stopping the flow of flush water to the toilet bowl. The amount of water which will pass from the tank under control of the float 42 in effecting a partial flush will depend on the normal position of the float 42 with respect to the normal water level A—A and will be in direct proportion to the distance between the level A—A and the normal position of the float 42. If it is desired to effect a complete flush the operating lever 8 is moved in the manner described above, raising the connecting member 40, float 42, and flap valve 30 to the position of the parts shown in FIG. 3. The pivoted end of the flap valve now engages parts of the frame 10 preventing further upward movement of the flap valve, and continued operation of lever 8 now causes upward movement of the frame about its pivoted support. After a very small increment of such movement the operator feels a detent caused by engagement of offset surfaces 54 with the upper ends of lugs 50 and knows that the partial flush cycle is ended and that further lever operation will produce a complete flush. Such further operation raises the frame about its pivotal support to the positions of the parts shown in FIG. 4, in the course of which the offset surfaces ride over the upper ends of the lugs 50. The water in the tank will now pass through the discharge pipe to the toilet bowl and will continue to do so until the water level reaches the float 24 which is attached to the frame and which is, of course, normally adjacent the bottom wall of the tank and therefore below float 42. Float 24 will now descend with the water level, carrying the frame with it. The flap valve will first move downwardly into its normal position within the frame and will then move downwardly with the frame, but will be prevented from moving through the frame by engagement of the arms 34, 36 with the upper surface of the frame. Thus, the frame and the flap valve will move downwardly with the descending float 24 until the frame rests on the bottom wall of the tank, in position the flap valve is fully closed. The conventional means for re-filling the tank when becomes operative.

I claim:

1. A flush valve assembly for controlling the flow of water from a storage tank to a toilet bowl through a discharge pipe opening at its upper end into the tank through its open upper end in order to selectively produce a larger or a smaller flow of water from the tank to the bowl, comprising:

a. an open frame adapted to be pivotally supported with respect to and adjacent the upper end of the discharge pipe within the tank, the frame being formed by side arms which are constructed and adapted to be positioned on opposite sides of the upper end of the discharge pipe and spaced therefrom, b. a first float carried by the frame at a location remote from the pivoted support of the frame, c. a single flap valve for controlling passage of water from the tank into the upper end of the discharge pipe, the valve being pivotally mounted on the frame at a location adjacent the position remote from the pivotal support of the frame said flap valve extending through said frame member for direct engagement with the discharge pipe, d. means on the flap valve and the frame for limiting upward pivotal movement of the flap valve, with respect to the frame, e. a strand connected at its lower end to the flap valve at a point remote from the pivotal support of the flap valve on the frame and extending upwardly therefrom for connection at its upper end to an operating lever for the toilet, f. a second float adjustably connected to the strand between its ends with the pivotal support for the frame member to provide a yieldable detent feel to the user when the frame member is pivoted after the flap valve has pivoted to its upward limit of pivotal movement with respect to the frame.

2. The assembly according to claim 1, in which the means for creating a detent feel comprises aligned pins on which the frame member is pivotally mounted, a vertical lug mounted on each pin externally of the adjacent arm of the frame member, each arm of the frame member having a transversely extending offset surface adjacent the adjacent lug and positioned to yieldingly engage the lug as the frame member is moved about its pivotal support.

3. The combination according to claim 2, in which each offset surface is inclined to the length of the arm of the frame member in which it is formed and to the adjacent lug.

4. The combination according to claim 2, in which each lug is rotatably mounted on a pin, and each arm of the frame member has an elongated opening therein extending parallel to the length of the arm to receive a lug.

5. The assembly according to claim 1, comprising in addition means carried by the flap valve for preventing downward movement of the flap valve through the frame member.

* * * * *